US012485475B2

(12) United States Patent
Lv et al.

(10) Patent No.: US 12,485,475 B2
(45) Date of Patent: Dec. 2, 2025

(54) COPPER-ALUMINUM COMPOSITE PLATE MATERIAL PREPARED BY ALUMINUM LIQUID CONTINUOUS CASTING AND PROCESS THEREOF

(71) Applicants: TRIO METAL (GZ) CO., LTD, Guangzhou (CN); GUANGZHOU ZHONGSHAN NEW ENERGY TECHNOLOGY CO., LTD., Guangzhou (CN)

(72) Inventors: Jiangang Lv, Guangzhou (CN); Fenglin Wang, Guangzhou (CN); Weifu Yang, Guangzhou (CN); Yufan Huang, Guangzhou (CN); Xuemin Zhai, Guangzhou (CN); Haiquan Feng, Guangzhou (CN)

(73) Assignees: TRIO METAL (GZ) CO., LTD, Guangzhou (CN); GUANGZHOU ZHONGSHAN NEW ENERGY TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 18/880,511

(22) PCT Filed: Dec. 9, 2024

(86) PCT No.: PCT/CN2024/137700

§ 371 (c)(1),
(2) Date: Dec. 31, 2024

(87) PCT Pub. No.: WO2025/067573

PCT Pub. Date: Apr. 3, 2025

(65) Prior Publication Data

US 2025/0326027 A1 Oct. 23, 2025

(30) Foreign Application Priority Data

Apr. 23, 2024 (CN) ..... 202410491363.3

(51) Int. Cl.

| | |
|---|---|
| ***B22D 11/00*** | (2006.01) |
| ***B21B 3/00*** | (2006.01) |
| ***B22D 11/108*** | (2006.01) |
| ***B22D 11/12*** | (2006.01) |
| ***C22C 1/10*** | (2023.01) |
| ***C22F 1/08*** | (2006.01) |

(52) U.S. Cl.

CPC ..... *B22D 11/007* (2013.01); *B21B 3/003* (2013.01); *B22D 11/003* (2013.01); *B22D 11/004* (2013.01); *B22D 11/108* (2013.01); *B22D 11/1213* (2013.01); *C22C 1/1015* (2013.01); *C22F 1/08* (2013.01); *B21B 2003/001* (2013.01); *B21B 2003/005* (2013.01)

(58) Field of Classification Search

CPC ... B22D 11/007; B22D 11/003; B22D 11/004; B22D 11/108; B22D 11/1213

See application file for complete search history.

(56) References Cited

U.S. PATENT DOCUMENTS

2022/0006145 A1* 1/2022 Su ..... H01M 50/147

FOREIGN PATENT DOCUMENTS

| | | | |
|---|---|---|---|
| CN | 1118382 | A | 6/1996 |
| CN | 101758071 | B | 1/2012 |
| CN | 114798726 | A | 7/2022 |
| KR | 20130068471 | A | 6/2013 |

* cited by examiner

*Primary Examiner* — Keith Walker
*Assistant Examiner* — Steven S Ha
(74) *Attorney, Agent, or Firm* — Muncy, Geissler, Olds & Lowe, P.C.

(57) ABSTRACT

A copper-aluminum composite plate material prepared by aluminum liquid continuous casting and a process thereof. The method includes: S1, heating an aluminum ingot to 700-800° C. and smelting for 1-3 h; S2, degassing smelted aluminum liquid, and keeping the temperature and standing; S3, texturing a copper strip, and then cleaning; S4, heating the pretreated copper strip to 200-650° C.; S5, under the protection of inert gas, continuously casting the treated aluminum liquid on the treated copper strip, performing quenching crystallization on a copper-aluminum composite material, and performing oxygen-free continuous casting; and S6, continuous rolling: rolling the continuously cast copper-aluminum composite material to obtain the copper-aluminum composite plate material prepared by aluminum liquid continuous casting.

7 Claims, No Drawings

COPPER-ALUMINUM COMPOSITE PLATE MATERIAL PREPARED BY ALUMINUM LIQUID CONTINUOUS CASTING AND PROCESS THEREOF

TECHNICAL FIELD

The present invention relates to the field of composite plate material technologies, in particular to a copper-aluminum composite plate material prepared by aluminum liquid continuous casting and a process thereof.

BACKGROUND ART

Copper and aluminum are important nonferrous metals. Copper has good electrical conductivity, thermal conductivity and corrosion resistance, and aluminum has good electrical conductivity and thermal conductivity. Compared with aluminum, copper resources are in short supply, aluminum resources are abundant, and the specific weight of aluminum is small and the price thereof is low. An aluminum-copper composite metal plate strip is a bimetal formed by coating copper with aluminum as a matrix outer layer. It is a new conductor material and decorative material that combines high-quality conductivity and low-cost resources of aluminum with high chemical stability and lower contact resistance of copper. The aluminum-copper composite metal plate strip integrates respective advantages of copper and aluminum. The aluminum-copper composite metal plate strip instead of a copper plate strip is widely used in high-tech fields such as military industry, aerospace, electronic computers and electronic devices, as well as electric power, high and low voltage electrical appliances, automation and construction industries, and is the research focus of current metal materials.

In international standards, the composite strength of a copper-aluminum composite material is ≥12 kgf/cm, and the requirement of existing lithium batteries for the composite strength of the copper-aluminum composite material is ≥15 kgf/cm. With the continuous development of new energy technology, the lithium batteries are core energy storage devices in new energy, and the copper-aluminum composite material is a core component material of the lithium battery. Therefore, lithium battery manufacturers put forward higher requirements for the strength of the copper-aluminum composite material.

At present, production methods of the copper-aluminum composite plate strip mainly include solid-solid composite methods such as rolled composite, explosive composite, extrusion-drawing composite and diffusion welding composite, and liquid-solid composite methods such as core-filled continuous casting and double-crystallizer continuous casting. The process of the solid-solid composite methods is generally backward, with low yield and unstable quality, and is not suitable for continuous large-scale production. Therefore, the liquid-solid composite methods have become the focus of research. However, the liquid-solid composite methods directly composite aluminum liquid with a copper plate, which will generate a very thick bonding interface layer. The thicker the bonding interface layer, the more intermetallic compounds and the lower the strength of the composite plate strip. Therefore, the bonding interface layer formed by directly compositing the aluminum liquid with the copper plate is thicker and the strength of the composite plate is lower, which cannot meet the requirements of use.

The Chinese invention patent CN101758071B discloses a production method of an aluminum-copper composite metal plate strip, which prepares the copper-aluminum composite plate strip by adopting an oxygen-free continuous casting-rolling method. This method needs to perform on-line polishing until there is no oxide layer before copper-aluminum bonding, the process is relatively complicated, and the copper-aluminum bonding strength is lower (about 100 MPa).

SUMMARY OF THE INVENTION

An objective of the present invention is to provide a copper-aluminum composite plate material prepared by aluminum liquid continuous casting and a process thereof, which can be used for preparing a pole of a new energy battery. Through the process of continuous casting and multiple rolling, the wettability of an aluminum-copper metal interface is improved, and the prepared composite plate material has high bonding strength, small interface thickness, high composite strength, good mechanical properties, simple preparation method, low cost, high efficiency and broad application prospects.

The technical solution of the present invention is realized in such a way:

The present invention provides a process of a copper-aluminum composite plate material prepared by aluminum liquid continuous casting, which includes the following steps:

S1, smelting: heating an aluminum ingot to 700-800° C. and smelting for 1-3 h;

S2, standing: degassing aluminum liquid smelted in step S1, and keeping the temperature and standing for 10-30 min;

S3, copper strip pretreatment: texturing the copper strip, and then cleaning;

S4, copper strip heating: heating the pretreated copper strip obtained in step S3 to 200-650° C.;

S5, continuous casting: under the protection of inert gas, continuously casting the aluminum liquid treated in step S2 on the copper strip treated in step S4, performing quenching crystallization on a copper-aluminum composite material, and performing oxygen-free continuous casting; and S6, continuous rolling: rolling the copper-aluminum composite material continuously cast in step S5 to obtain the copper-aluminum composite plate material prepared by aluminum liquid continuous casting.

As an improvement of the present invention, the texturing in step S3 includes mechanical texturing, chemical texturing or laser texturing, the mechanical texturing is texturing with a steel brush or an abrasive belt; and the cleaning is ultrasonic cleaning or laser cleaning.

As a further improvement of the present invention, in step S5, a casting speed is 200-1200 mm/min; a casting width is 10-100 mm; a casting thickness is 3-20 mm, a cooling rate of the quenching crystallization is 100-150° C./min, and the specific method is as follows: under the protection of inert gas, enabling the copper strip treated in step S4 to continuously pass through a continuous casting device and a crystallizer, continuously casting the aluminum liquid on the copper strip through a casting system, performing quenching crystallization on the copper-aluminum composite material through the crystallizer, and performing oxygen-free continuous casting.

As a further improvement of the present invention, in step S6, a thickness of the copper-aluminum composite plate material prepared by aluminum liquid continuous casting is 2-12 mm, a rolling pressure is 5000-5000000 N, a rolling speed is 300-1500 mm/min, and a rolling tension is 10000-200000 N.

As a further improvement of the present invention, in step S2, Cu@Si@Al Janus nanosheets in an amount of 5-7 wt % of the aluminum liquid are added before degassing treatment, and a preparation method of the Cu@Si@Al Janus nanosheets is as follows:

T1, preparation of $SiO_2$ hollow nanospheres: dissolving ethyl orthosilicate in an organic solvent to prepare an oil phase; dissolving an emulsifier in water to prepare a water phase; dropwise adding the water phase into the oil phase, emulsifying, adjusting a pH value of the solution to 10-11, performing heating and stirring reaction, centrifuging, washing, drying and calcining to prepare $SiO_2$ hollow nanospheres;

T2, ball milling: performing ball milling on the $SiO_2$ hollow nanospheres prepared in step T1 to prepare $SiO_2$ nanosheets;

T3, modification: adding the $SiO_2$ nanosheets prepared in step T2 into ethanol, adding a silane coupling agent, performing heating and stirring reaction, centrifuging, washing and drying to prepare modified $SiO_2$ nanosheets;

T4, preparation of $CuO@SiO_2@Al_2O_3$ nanosheets: dissolving aluminum isopropoxide in dichloromethane, standing, adding the modified $SiO_2$ nanosheets prepared in step T3, which float on the interface, dropwise adding an aqueous solution containing a copper salt, then adding citric acid, performing standing reaction, centrifuging, washing, drying and calcining to prepare $CuO@SiO_2@Al_2O_3$ nanosheets; and T5, reduction: mixing the $CuO@SiO_2@Al_2O_3$ nanosheets prepared in step T4 with magnesium powder, performing heating reduction reaction, and then performing hydrogen reduction reaction to prepare the Cu@Si@Al Janus nanosheets.

As a further improvement of the present invention, in step T1, a mass ratio of the ethyl orthosilicate, organic solvent, emulsifier and water is 12-15:100:0.5-1:30-50, the emulsifier is selected from at least one of Tween-20, Tween-40, Tween-60 and Tween-80, a temperature of the heating and stirring reaction is 50-60° C. for 10-12 h, and a temperature of the calcining is 300-500° C. for 1-3 h; time of the ball milling in step T2 is 2-4 h; and in step T3, a mass ratio of the $SiO_2$ nanosheets to the silane coupling agent is 100:22-25, the silane coupling agent is a silane coupling agent with amino groups and is selected from at least one of KH550, KH602 and KH792, and a temperature of the heating and stirring reaction is 40-50° C. for 0.5-1 h.

As a further improvement of the present invention, in step T4, a mass ratio of the modified $SiO_2$ nanosheets, aluminum isopropoxide, copper salt and citric acid is 50:12-15:7-12:3-5, time of the standing reaction is 30-50 min, a temperature of the calcining is 500-700° C. for 1-3 h, and the copper salt is selected from at least one of copper chloride, copper sulfate and copper nitrate; and in step T5, a mass ratio of the $CuO@SiO_2@Al_2O_3$ nanosheets to the magnesium powder is 100:7-12, a temperature of the heating reduction reaction is 700-800° C. for 0.5-1 h, a temperature of the hydrogen reduction reaction is 600-800° C. for 1-2 h, and a ventilation rate of hydrogen is 20-30 mL/min.

As a further improvement of the present invention, after the cleaning in step S3, the surface is coated with a layer of ethylene glycol dimethyl ether solution of 11-mercaptoundecanoic acid with a concentration of 7-12 wt %.

The present invention further claims a copper-aluminum composite plate material prepared by aluminum liquid continuous casting prepared by the above preparation process.

The present invention further claims an application of the above copper-aluminum composite plate material prepared by aluminum liquid continuous casting in preparation of poles of new energy batteries.

The present invention has the following beneficial effects:

When the wettability between metal matrixes is poorer, interface defects such as interface pores and cracks will be generated between the metal matrixes in a preparation process, which will lead to brittle phase compounds generated at the interface and reduce the bonding strength between metals, thus affecting the service performance of alloy materials.

According to the present invention, the Cu@Si@Al Janus nanosheets are prepared. First, silica hollow nanospheres are prepared by an emulsion method, and are crushed under the action of ball milling to form the nanosheets. Then, after the surface is modified by the silane coupling agent with amino groups, the nanosheets are added into the organic solvent and the aqueous solution. The modified silica nanosheets are dispersed at an oil-water interface, aluminum isopropoxide is dissolved in the organic solvent and the copper salt is dissolved in water. Under the action of the amino groups on the modified silica nanosheets, aluminum isopropoxide is attached to the surface of the nanosheets, and a sol-gel reaction occurs under the catalysis of a small amount of water, so that alumina is formed and fixed on the side of the nanosheets close to an oil layer. At the same time, copper ions are fixed on the amino groups on the side of the nanosheets close to a water layer under a complexation action of the amino groups, and citric acid is further added to form a gel. After the nanosheets are separated, the nanosheets are calcined, so as to prepare the $CuO@SiO_2@Al_2O_3$ nanosheets. After magnesium thermal reduction and hydrogen reduction, Cu@Si@Al Janus nanosheets are prepared.

According to the present invention, the Cu@Si@Al Janus nanosheets are added into the aluminum liquid, and automatically dissociate to the aluminum-copper metal interface, the layer on the nanosheets with aluminum metal permeates to the aluminum metal layer, and the layer with copper metal permeates to the copper metal layer. After rolling, the thickness of the interface layer is greatly reduced, and the pores or air gaps existing at the interface are also reduced, so that the bonding strength and composite strength are improved, and the mechanical properties of the prepared composite plate material are enhanced.

According to the present invention, the copper strip is textured, so that the interface becomes rough, and the interface bonding force is enhanced; furthermore, the layer of 11-mercaptoundecanoic acid solution is coated on the surface; since the molecular structure contains sulfur groups and carboxyl groups, better surface activity is realized, and an organic-inorganic composite layer is formed by in-situ reaction, so that the wettability and dispersibility of the metal interface are improved, thereby obviously improving the infiltration and composition between the copper matrix and the aluminum matrix, and improving the interface bonding force between the copper matrix and the aluminum matrix.

The copper-aluminum composite plate material prepared by aluminum liquid continuous casting according to the present invention can be used to prepare the pole of a new energy battery, the wettability of the aluminum-copper metal interface is improved through the process of continuous casting and multiple rolling, and the prepared composite plate material has high bonding strength, small interface thickness, high composite strength, good mechanical properties, simple preparation method, low cost, high efficiency, and broad application prospects.

DETAILED DESCRIPTION

The technical solution in the embodiments of the present invention will be described clearly and completely below. Apparently, the described embodiments are only part but not all of the embodiments of the present invention. Based on the embodiments in the present invention, all other embodiments obtained by those skilled in the art without creative labor belong to the scope of protection of the present invention.

Preparation Embodiment 1: Preparation of Cu@Si@Al Janus Nanosheets

The method is as follows:

T1, preparation of $SiO_2$ hollow nanospheres: dissolving 12 parts by weight of ethyl orthosilicate in 100 parts by weight of dichloromethane to prepare an oil phase; dissolving 0.5 part by weight of Tween-20 in 30 parts by weight of water to prepare a water phase; dropwise adding the water phase into the oil phase, emulsifying at 10000 r/min for 15 min, adjusting a pH value of the solution to 10, heating to 50° C., stirring for reaction for 10 h, centrifuging, washing, drying, and calcining at 300° C. for 1 h to prepare $SiO_2$ hollow nanospheres;

T2, ball milling: performing ball milling on the $SiO_2$ hollow nanospheres prepared in step T1 for 2 h to prepare $SiO_2$ nanosheets;

T3, modification: adding 100 parts by weight of the $SiO_2$ nanosheets prepared in step T2 into 200 parts by weight of ethanol, adding 22 parts by weight of silane coupling agent KH550, heating to 40° C., stirring for reaction for 0.5 h, centrifuging, washing and drying to prepare modified $SiO_2$ nanosheets;

T4, preparation of $CuO@SiO_2@Al_2O_3$ nanosheets: dissolving 12 parts by weight of aluminum isopropoxide in 100 parts by weight of dichloromethane, standing, adding 50 parts by weight of the modified $SiO_2$ nanosheets prepared in step T3, which float on the interface, dropwise adding 100 parts by weight of aqueous solution containing 7 parts by weight of copper chloride, then adding 3 parts by weight of citric acid, standing for reaction for 30 min, centrifuging, washing, drying, and calcining at 500° C. for 1 h to prepare $CuO@SiO_2@Al_2O_3$ nanosheets; and T5, reduction: mixing 100 parts by weight of the $CuO@SiO_2@Al_2O_3$ nanosheets prepared in step T4 with 7 parts by weight of magnesium powder, heating to 700° C., performing reduction reaction for 0.5 h, and then performing hydrogen reduction reaction at 600° C. for 1 h, with a ventilation rate of hydrogen being 20 mL/min to prepare Cu@Si@Al Janus nanosheets.

Preparation Embodiment 2: Preparation of Cu@Si@Al Janus Nanosheets

The method is as follows:

T1, preparation of $SiO_2$ hollow nanospheres: dissolving 15 parts by weight of ethyl orthosilicate in 100 parts by weight of dichloromethane to prepare an oil phase; dissolving 1 part by weight of Tween-40 in 50 parts by weight of water to prepare a water phase; dropwise adding the water phase into the oil phase, emulsifying at 10000 r/min for 15 min, adjusting a pH value of the solution to 11, heating to 60° C., stirring for reaction for 12 h, centrifuging, washing, drying and calcining at 500° C. for 3 h to prepare $SiO_2$ hollow nanospheres;

T2, ball milling: performing ball milling on the $SiO_2$ hollow nanospheres prepared in step T1 for 4 h to prepare $SiO_2$ nanosheets;

T3, modification: adding 100 parts by weight of the $SiO_2$ nanosheets prepared in step T2 into 200 parts by weight of ethanol, adding 25 parts by weight of silane coupling agent KH602, heating to 50° C., stirring for reaction for 1 h, centrifuging, washing and drying to prepare modified $SiO_2$ nanosheets;

T4, preparation of $CuO@SiO_2@Al_2O_3$ nanosheets: dissolving 15 parts by weight of aluminum isopropoxide in 100 parts by weight of dichloromethane, standing, adding 50 parts by weight of the modified $SiO_2$ nanosheets prepared in step T3, which float on the interface, dropwise adding 100 parts by weight of aqueous solution containing 12 parts by weight of copper sulfate, then adding 5 parts by weight of citric acid, standing for reaction for 50 min, centrifuging, washing, drying, and calcining at 700° C. for 3 h to prepare $CuO@SiO_2@Al_2O_3$ nanosheets; and T5, reduction: mixing 100 parts by weight of the $CuO@SiO_2@Al_2O_3$ nanosheets prepared in step T4 with 12 parts by weight of magnesium powder, heating to 800° C., performing reduction reaction for 1 h, and then performing hydrogen reduction reaction at 800° C. for 2 h, with a ventilation rate of hydrogen being 30 mL/min to prepare Cu@Si@Al Janus nanosheets.

Preparation Embodiment 3: Preparation of Cu@Si@Al Janus Nanosheets

The method is as follows:

T1, preparation of $SiO_2$ hollow nanospheres: dissolving 13 parts by weight of ethyl orthosilicate in 100 parts by weight of dichloromethane to prepare an oil phase; dissolving 0.7 part by weight of Tween-80 in 40 parts by weight of water to prepare a water phase; dropwise adding the water phase into the oil phase, emulsifying at 10000 r/min for 15 min, adjusting a pH value of the solution to 10.5, heating to 55° C., stirring for reaction for 11 h, centrifuging, washing, drying, and calcining at 400° C. for 2 h to prepare $SiO_2$ hollow nanospheres;

T2, ball milling: performing ball milling on the $SiO_2$ hollow nanospheres prepared in step T1 for 3 h to prepare $SiO_2$ nanosheets;

T3, modification: adding 100 parts by weight of the $SiO_2$ nanosheets prepared in step T2 into 200 parts by weight of ethanol, adding 23 parts by weight of silane coupling agent, heating to 45° C., stirring for reaction for 1 h, centrifuging, washing and drying to prepare modified $SiO_2$ nanosheets;

T4, preparation of $CuO@SiO_2@Al_2O_3$ nanosheets: dissolving 13 parts by weight of aluminum isopropoxide in 100 parts by weight of dichloromethane, standing, adding 50 parts by weight of the modified $SiO_2$ nanosheets prepared in step T3, which float on the interface, dropwise adding 100 parts by weight of aqueous solution containing 10 parts by weight of copper nitrate, then adding 4 parts by weight of citric acid, standing for reaction for 40 min, centrifuging, washing, drying and calcining at 600° C. for 2 h to prepare $CuO@SiO_2@Al_2O_3$ nanosheets;

T5, reduction: mixing 100 parts by weight of the $CuO@SiO_2@Al_2O_3$ nanosheets prepared in step T4 with 10 parts by weight of magnesium powder, heating to 750° C., performing reduction reaction for 1 h, and then performing hydrogen reduction reaction at 700° C. for 1.5 h, with a ventilation rate of hydrogen being 25 mL/min to prepare Cu@Si@Al Janus nanosheets.

Comparative Preparation Embodiment 1

Compared with Preparation Example 3, the difference is that step T3 is not performed.

The method is as follows:

T1, preparation of $SiO_2$ hollow nanospheres: dissolving 13 parts by weight of ethyl orthosilicate in 100 parts by weight of dichloromethane to prepare an oil phase; dissolving 0.7 part by weight of Tween-80 in 40 parts by weight of water to prepare a water phase; dropwise adding the water phase into the oil phase, emulsifying at 10000 r/min for 15 min, adjusting a pH value of the solution to 10.5, heating to 55° C., stirring for reaction for 11 h, centrifuging, washing, drying, and calcining at 400° C. for 2 h to prepare $SiO_2$ hollow nanospheres;

T2, ball milling: performing ball milling on the $SiO_2$ hollow nanospheres prepared in step T1 for 3 h to prepare $SiO_2$ nanosheets;

T3, preparation of $CuO@SiO_2@Al_2O_3$ nanosheets: dissolving 13 parts by weight of aluminum isopropoxide in 100 parts by weight of dichloromethane, standing, adding 50 parts by weight of the $SiO_2$ nanosheets prepared in step T2, which float on the interface, dropwise adding 100 parts by weight of aqueous solution containing 10 parts by weight of copper nitrate, then adding 4 parts by weight of citric acid, standing for reaction for 40 min, centrifuging, washing, drying and calcining at 600° C. for 2 h to prepare $CuO@SiO_2@Al_2O_3$ nanosheets; and T4, reduction: mixing 100 parts by weight of the $CuO@SiO_2@Al_2O_3$ nanosheets prepared in step T3 with 10 parts by weight of magnesium powder, heating to 750° C., performing reduction reaction for 1 h, and then performing hydrogen reduction reaction at 700° C. for 1.5 h, with a ventilation rate of hydrogen being 25 mL/min to prepare Cu@Si@Al Janus nanosheets.

Comparative Preparation Embodiment 2

Compared with Preparation Example 3, the difference is that step T5 is not performed.

The method is as follows:

T1, preparation of $SiO_2$ hollow nanospheres: dissolving 13 parts by weight of ethyl orthosilicate in 100 parts by weight of dichloromethane to prepare an oil phase; dissolving 0.7 part by weight of Tween-80 in 40 parts by weight of water to prepare a water phase; dropwise adding the water phase into the oil phase, emulsifying at 10000 r/min for 15 min, adjusting a pH value of the solution to 10.5, heating to 55° C., stirring for reaction for 11 h, centrifuging, washing, drying, and calcining at 400° C. for 2 h to prepare $SiO_2$ hollow nanospheres;

T2, ball milling: performing ball milling on the $SiO_2$ hollow nanospheres prepared in step T1 for 3 h to prepare $SiO_2$ nanosheets;

T3, modification: adding 100 parts by weight of the $SiO_2$ nanosheets prepared in step T2 into 200 parts by weight of ethanol, adding 23 parts by weight of silane coupling agent, heating to 45° C., stirring for reaction for 1 h, centrifuging, washing and drying to prepare modified $SiO_2$ nanosheets;

T4, preparation of $CuO@SiO_2@Al_2O_3$ nanosheets: dissolving 13 parts by weight of aluminum isopropoxide in 100 parts by weight of dichloromethane, standing, adding 50 parts by weight of the modified $SiO_2$ nanosheets prepared in step T3, which float on the interface, dropwise adding 100 parts by weight of aqueous solution containing 10 parts by weight of copper nitrate, then adding 4 parts by weight of citric acid, standing for reaction for 40 min, centrifuging, washing, drying and calcining at 600° C. for 2 h to prepare $CuO@SiO_2@Al_2O_3$ nanosheets.

Embodiment 1

The present embodiment provides a process of a copper-aluminum composite plate material prepared by aluminum liquid continuous casting, which includes the following steps:

S1, smelting: heating an industrial LF21 pure aluminum ingot to 750° C. and smelting for 2 h;

S2, standing: degassing the aluminum liquid smelted in step S1, and keeping the temperature and standing for 20 min;

S3, copper strip pretreatment: treating a red copper T2 copper strip of 2 mm thick with steel brush hair, and then performing ultrasonic cleaning for 10 min;

S4, copper strip heating: heating the pretreated copper strip obtained in step S3 to 350° C.;

S5, continuous casting: under the protection of nitrogen, enabling the copper strip treated in step S4 to continuously pass through a continuous casting device and a crystallizer, continuously casting the aluminum liquid treated in step S2 on the copper strip through a casting system, performing quenching crystallization on a copper-aluminum composite material by the crystallizer and performing oxygen-free continuous casting;

wherein a casting speed is 1000 mm/min; a casting width is 50 mm; a casting thickness is 10 mm, and a cooling rate of the quenching crystallization is 120° C./min; and S6, continuous rolling: rolling the copper-aluminum composite material continuously cast in step S5 to prepare a copper-aluminum composite plate material prepared by aluminum liquid continuous casting;

wherein a thickness of the copper-aluminum composite plate material prepared by liquid aluminum continuous casting is 7 mm, a rolling pressure is 1000000 N, a rolling speed is 1000 mm/min, and a rolling tension is 100000 N.

Embodiment 2

The present embodiment provides a process of a copper-aluminum composite plate material prepared by aluminum liquid continuous casting, which includes the following steps:

S1, smelting: heating an industrial LF21 pure aluminum ingot to 750° C. and smelting for 2 h;

S2, standing: adding the Cu@Si@Al Janus nanosheets prepared in Preparation Example 1 into the aluminum liquid smelted in step S1, wherein an addition amount is 6 wt % of the aluminum liquid, stirring and mixing for 30 min, degassing, and keeping the temperature and standing for 20 min;

S3, copper strip pretreatment: treating a red copper T2 copper strip of 2 mm thick with steel brush hair, and then performing ultrasonic cleaning for 10 min;

S4, copper strip heating: heating the pretreated copper strip obtained in step S3 to 300° C.;

S5, continuous casting: under the protection of nitrogen, enabling the copper strip treated in step S4 to continuously pass through a continuous casting device and a crystallizer, continuously casting the aluminum liquid treated in step S2 on the copper strip through a casting system, performing quenching crystallization on a copper-aluminum composite material by the crystallizer and performing oxygen-free continuous casting;

wherein a casting speed is 1000 mm/min; a casting width is 50 mm; a casting thickness is 10 mm, and a cooling rate of the quenching crystallization is 120° C./min; and S6, continuous rolling: rolling the copper-aluminum composite material continuously cast in step S5 to prepare a copper-aluminum composite plate material prepared by liquid aluminum continuous casting;

wherein a thickness of the copper-aluminum composite plate material prepared by liquid aluminum continuous casting is 7 mm, a rolling pressure is 1000000 N, a rolling speed is 1000 mm/min, and a rolling tension is 100000 N.

Embodiment 3

The present embodiment provides a process of a copper-aluminum composite plate material prepared by aluminum liquid continuous casting, which includes the following steps:

S1, smelting: heating an industrial LF21 pure aluminum ingot to 700° C. and smelting for 1 h;

S2, standing: adding the Cu@Si@Al Janus nanosheets prepared in Preparation Example 1 into the aluminum liquid smelted in step S1, wherein an addition amount is 5 wt % of the aluminum liquid, stirring and mixing for 30 min, degassing, and keeping the temperature and standing for 10 min;

S3, copper strip pretreatment: treating a red copper T2 copper strip of 2 mm thick with steel brush hair, and then performing ultrasonic cleaning for 10 min, wherein the surface is coated with a layer of ethylene glycol dimethyl ether solution of 11-mercapto undecanoic acid with a concentration of 7 wt %;

S4, copper strip heating: heating the pretreated copper strip obtained in step S3 to 350° C.;

S5, continuous casting: under the protection of nitrogen, enabling the copper strip treated in step S4 to continuously pass through a continuous casting device and a crystallizer, continuously casting the aluminum liquid treated in step S2 on the copper strip through a casting system, performing quenching crystallization on a copper-aluminum composite material by the crystallizer and performing oxygen-free continuous casting;

wherein a casting speed is 1000 mm/min; a casting width is 50 mm; a casting thickness is 10 mm, and a cooling rate of the quenching crystallization is 100° C./min; and S6, continuous rolling: rolling the copper-aluminum composite material continuously cast in step S5 to prepare a copper-aluminum composite plate material prepared by liquid aluminum continuous casting;

wherein a thickness of the copper-aluminum composite plate material prepared by liquid aluminum continuous casting is 7 mm, a rolling pressure is 1000000 N, a rolling speed is 1000 mm/min, and a rolling tension is 100000 N.

Embodiment 4

The present embodiment provides a process of a copper-aluminum composite plate material prepared by aluminum liquid continuous casting, which includes the following steps:

S1, smelting: heating an aluminum ingot to 800° C. and smelting for 3 h;

S2, standing: adding the Cu@Si@Al Janus nanosheets prepared in Preparation Example 2 into the aluminum liquid smelted in step S1, wherein an addition amount is 7 wt % of the aluminum liquid, stirring and mixing for 30 min, degassing, and keeping the temperature and standing for 30 min;

S3, copper strip pretreatment: treating a red copper T2 copper strip of 2 mm thick with steel brush hair, and then performing ultrasonic cleaning for 10 min, wherein the surface is coated with a layer of ethylene glycol dimethyl ether solution of 11-mercapto undecanoic acid with a concentration of 12 wt %;

S4, copper strip heating: heating the pretreated copper strip obtained in step S3 to 350° C.;

S5, continuous casting: under the protection of nitrogen, enabling the copper strip treated in step S4 to continuously pass through a continuous casting device and a crystallizer, continuously casting the aluminum liquid treated in step S2 on the copper strip through a casting system, performing quenching crystallization on a copper-aluminum composite material by the crystallizer and performing oxygen-free continuous casting;

wherein a casting speed is 1000 mm/min; a casting width is 50 mm; a casting thickness is 10 mm, and a cooling rate of the quenching crystallization is 150° C./min; and S6, continuous rolling: rolling the copper-aluminum composite material continuously cast in step S5 to prepare a copper-aluminum composite plate material prepared by aluminum liquid continuous casting;

wherein a thickness of the copper-aluminum composite plate material prepared by liquid aluminum continuous casting is 7 mm, a rolling pressure is 1000000 N, a rolling speed is 1000 mm/min, and a rolling tension is 100000 N.

Embodiment 5

The present embodiment provides a process of a copper-aluminum composite plate material prepared by aluminum liquid continuous casting, which includes the following steps:

S1, smelting: heating an industrial LF21 pure aluminum ingot to 750° C. and smelting for 2 h;

S2, standing: adding the Cu@Si@Al Janus nanosheets prepared in Preparation Example 3 into the aluminum liquid smelted in step S1, wherein an addition amount is 6 wt % of the aluminum liquid, stirring and mixing for 30 min, degassing, and keeping the temperature and standing for 20 min;

S3, copper strip pretreatment: treating a red copper T2 copper strip of 2 mm thick with steel brush hair, and then performing ultrasonic cleaning for 10 min, wherein the surface is coated with a layer of ethylene glycol dimethyl ether solution of 11-mercapto undecanoic acid with a concentration of 10 wt %;

S4, copper strip heating: heating the pretreated copper strip obtained in step S3 to 350° C.;

S5, continuous casting: under the protection of nitrogen, enabling the copper strip treated in step S4 to continuously pass through a continuous casting device and a crystallizer, continuously casting the aluminum liquid treated in step S2 on the copper strip through a casting system, performing quenching crystallization on a copper-aluminum composite material by the crystallizer and performing oxygen-free continuous casting;

wherein a casting speed is 1000 mm/min; a casting width is 50 mm; a casting thickness is 10 mm, and a cooling rate of the quenching crystallization is 120° C./min; and S6, continuous rolling: rolling the copper-aluminum composite material continuously cast in step S5 to prepare a copper-aluminum composite plate material prepared by aluminum liquid continuous casting;

wherein a thickness of the copper-aluminum composite plate material prepared by liquid aluminum continuous casting is 7 mm, a rolling pressure is 1000000 N, a rolling speed is 1000 mm/min, and a rolling tension is 100000 N.

Comparative Embodiment 1

Compared with Embodiment 5, the difference is that the Cu@Si@Al Janus nanosheets are prepared by Comparative Preparation Embodiment 1.

Comparative Embodiment 2

Compared with Embodiment 5, the difference is that the Cu@Si@Al Janus nanosheets are prepared by Comparative Preparation Embodiment 2.

Test Embodiment 1

The properties of the copper-aluminum composite plate materials prepared by aluminum liquid continuous casting prepared in Embodiments 1-5 and Comparative Embodiment 1-2 of the present invention and commercially available similar products were tested. The results are shown in Table 1.

TABLE 1

| Groups | Bonding strength (MPa) | Composite strength (N/mm) | Shear strength (MPa) | Interface layer thickness (μm) |
|---|---|---|---|---|
| Embodiment 1 | 152 | 104.4 | 34.5 | 55 |
| Embodiment 2 | 170 | 111.8 | 39.5 | 18 |
| Embodiment 3 | 179 | 114.2 | 42.1 | 7 |
| Embodiment 4 | 181 | 113.9 | 41.8 | 7 |
| Embodiment 5 | 182 | 114.5 | 42.6 | 5 |
| Comparative Embodiment 1 | 161 | 106.2 | 35.4 | 47 |
| Comparative Embodiment 2 | 165 | 108.6 | 38.9 | 22 |
| Commercially available | 127 | 78.1 | 25.2 | 147 |

From the above table, it can be seen that the copper-aluminum composite plate materials prepared by aluminum liquid continuous casting prepared in Embodiments 2-5 of the present invention have very well bonding strength and composite strength, large shear strength and small interface layer thickness.

The foregoing is merely preferred embodiments of the present invention, and not used to limit the present invention. Any amendments, equivalent substitutions, improvements and the like made within the spirit and principle of the present invention should be included in the protection scope of the present invention.

The invention claimed is:

1. A process of a copper-aluminum composite plate material prepared by aluminum liquid continuous casting, comprising the following steps:

S1, smelting: heating an aluminum ingot to 700-800° C. and smelting for 1-3 h;

S2, standing: degassing aluminum liquid smelted in step S1, and keeping a temperature and standing for 10-30 min; adding Cu@Si@Al Janus nanosheets in an amount of 5-7 wt % of the aluminum liquid before degassing treatment, wherein a preparation method of the Cu@Si@Al Janus nanosheets is as follows:

T1, preparation of $SiO_2$ hollow nanospheres: dissolving ethyl orthosilicate in an organic solvent to prepare an oil phase; dissolving an emulsifier in water to prepare a water phase;

dropwise adding the water phase into the oil phase, emulsifying, adjusting a pH value of a solution to 10-11, performing heating and stirring reaction, centrifuging, washing, drying and calcining to prepare $SiO_2$ hollow nanospheres;

T2, ball milling: performing ball milling on the $SiO_2$ hollow nanospheres prepared in step T1 to prepare $SiO_2$ nanosheets;

T3, modification: adding the $SiO_2$ nanosheets prepared in step T2 into ethanol, adding a silane coupling agent, performing heating and stirring reaction, centrifuging, washing and drying to prepare modified $SiO_2$ nanosheets;

T4, preparation of $CuO@SiO_2@Al_2O_3$ nanosheets: dissolving aluminum isopropoxide in dichloromethane, standing, adding the modified $SiO_2$ nanosheets prepared in step T3, which float on an interface, dropwise adding an aqueous solution containing a copper salt, then adding citric acid, performing standing reaction, centrifuging, washing, drying and calcining to prepare $CuO@SiO_2@Al_2O_3$ nanosheets; and T5, reduction: mixing the $CuO@SiO_2@Al_2O_3$ nanosheets prepared in step T4 with magnesium powder, performing heating reduction reaction, and then performing hydrogen reduction reaction to prepare the Cu@Si@Al Janus nanosheets;

S3, copper strip pretreatment: texturing a copper strip, and then cleaning;

S4, copper strip heating: heating the pretreated copper strip obtained in step S3 to 200-650° C.;

S5, continuous casting: under protection of inert gas, continuously casting the aluminum liquid treated in step S2 on the copper strip treated in step S4, performing quenching crystallization on a copper-aluminum composite material, and performing oxygen-free continuous casting; and S6, continuous rolling: rolling the copper-aluminum composite material continuously cast in step S5 to obtain the copper-aluminum composite plate material prepared by aluminum liquid continuous casting.

2. The process according to claim 1, wherein the texturing in step S3 comprises mechanical texturing, chemical texturing or laser texturing, the mechanical texturing is texturing with a steel brush or an abrasive belt, and the cleaning is ultrasonic cleaning or laser cleaning.

3. The process according to claim 1, wherein in step S5, a casting speed is 200-1200 mm/min; a casting width is 10-100 mm; a casting thickness is 3-20 mm, a cooling rate of the quenching crystallization is 100-150° C./min.

4. The process according to claim 1, wherein in step S6, a thickness of the copper-aluminum composite plate material prepared by continuously casting the aluminum liquid is 2-12 mm, a rolling pressure is 5000-5000000 N, a rolling speed is 300-1500 mm/min, and a rolling tension is 10000-200000 N.

5. The process according to claim 1, wherein in step T1, a mass ratio of the ethyl orthosilicate, organic solvent, emulsifier and water is 12-15:100:0.5-1:30-50, the emulsifier is selected from at least one of Tween-20, Tween-40, Tween-60 and Tween-80, a temperature of the heating and stirring reaction is 50-60° C. for 10-12 h, and a temperature of the calcining is 300-500° C. for 1-3 h; time of the ball milling in step T2 is 2-4 h; and in step T3, a mass ratio of the $SiO_2$ nanosheets to the silane coupling agent is 100:22-25, the silane coupling agent is a silane coupling agent with amino groups and is selected from at least one of KH550, KH602 and KH792, and a temperature of the heating and stirring reaction is 40-50° C. for 0.5-1 h.

6. The process according to claim 1, wherein in step T4, a mass ratio of the modified $SiO_2$ nanosheets, aluminum isopropoxide, copper salt and citric acid is 50:12-15:7-12:3-5, time of the standing reaction is 30-50 min, a temperature of the calcining is 500-700° C. for 1-3 h, and the copper salt is selected from at least one of copper chloride, copper sulfate and copper nitrate; and in step T5, a mass ratio of the $CuO@SiO_2@Al_2O_3$ nanosheets to the magnesium powder is 100:7-12, a temperature of the heating reduction reaction is 700-800° C. for 0.5-1 h, a temperature of the hydrogen reduction reaction is 600-800° C. for 1-2 h, and a ventilation rate of hydrogen is 20-30 mL/min.

7. The process according to claim 1, wherein after the cleaning in step S3, a surface is coated with a layer of ethylene glycol dimethyl ether solution of 11-mercapto undecanoic acid with a concentration of 7-12 wt %.

* * * * *